US010033162B2

(12) United States Patent
Urciuoli et al.

(10) Patent No.: US 10,033,162 B2
(45) Date of Patent: Jul. 24, 2018

(54) HIGH VOLTAGE CONNECTION SEALING METHOD FOR CORONA IGNITION COIL

(71) Applicant: FEDERAL-MOGUL LLC, Southfield, MI (US)

(72) Inventors: Vittorio Urciuoli, Modena (IT); Giulio Milan, Northville, MI (US); Massimo Augusto Dal Re, Fossa di Concordia (IT); Paolo Pignatti, Carpi (IT)

( * ) Notice: Subject to any disclaimer, the term of this patent is extended or adjusted under 35 U.S.C. 154(b) by 0 days.

(21) Appl. No.: 15/595,142

(22) Filed: May 15, 2017

(65) Prior Publication Data

US 2017/0250524 A1 Aug. 31, 2017

Related U.S. Application Data

(63) Continuation of application No. 14/215,375, filed on Mar. 17, 2014, now Pat. No. 9,653,885.

(60) Provisional application No. 61/787,406, filed on Mar. 15, 2013.

(51) Int. Cl.

| | |
|---|---|
| ***H01T 13/06*** | (2006.01) |
| ***H01T 19/00*** | (2006.01) |
| ***H01T 13/50*** | (2006.01) |
| ***H01T 13/04*** | (2006.01) |
| *H01T 21/02* | (2006.01) |
| *H01T 13/08* | (2006.01) |
| *F02P 23/04* | (2006.01) |

(52) U.S. Cl.
CPC ..... *H01T 13/06* (2013.01); *H01T 13/04* (2013.01); *H01T 13/50* (2013.01); *H01T 19/00* (2013.01); *F02P 23/04* (2013.01); *H01T 13/08* (2013.01); *H01T 21/02* (2013.01)

(58) Field of Classification Search
CPC ..... H01T 13/00; H01T 13/02; H01T 13/06; H01T 13/08; H01T 13/20; H01T 13/34; H01T 13/36; H01T 19/00–19/04
See application file for complete search history.

(56) References Cited

U.S. PATENT DOCUMENTS

| | | | | |
|---|---|---|---|---|
| 4,232,242 A * | 11/1980 | Hsu | H01T 13/08 | 313/120 |
| 4,671,586 A * | 6/1987 | DeBolt | H01T 13/05 | 439/126 |
| 4,947,809 A * | 8/1990 | Hocking | H01T 13/06 | 123/169 PA |
| 5,842,458 A * | 12/1998 | Alstrin | F02P 13/00 | 123/169 PA |
| 7,825,573 B2 * | 11/2010 | Callahan | H01T 13/08 | 313/135 |

(Continued)

*Primary Examiner* — Thienvu Tran
*Assistant Examiner* — Christopher Clark
(74) *Attorney, Agent, or Firm* — Robert L. Stearns; Dickinson Wright, PLLC

(57) ABSTRACT

A corona igniter assembly 20 comprises an ignition coil assembly 22, a firing end assembly 24, and a metal tube 26 connecting the ignition coil assembly 22 to the firing end assembly 24. A rubber boot 28 is disposed in the metal tube 26 and compressed symmetrically between a coil output member 30 of the ignition coil assembly 22 and an insulator 42 of the firing end assembly 24. Thus, the rubber boot 28 fills any air gaps and provides a hermetic seal between the ignition coil assembly 22 and the firing end assembly 24 to prevent unwanted corona discharge from forming from those air gaps.

14 Claims, 7 Drawing Sheets

(56) References Cited

U.S. PATENT DOCUMENTS

| | | | | |
|---|---|---|---|---|
| 8,707,922 | B2 * | 4/2014 | Burrows | H01T 13/20 123/169 EL |
| 8,749,126 | B2 * | 6/2014 | Durham | H01T 13/50 123/169 EL |
| 8,776,751 | B2 * | 7/2014 | Hampton | H01T 13/467 123/143 R |
| 8,839,753 | B2 * | 9/2014 | Burrows | H01T 13/50 123/143 B |
| 8,853,924 | B2 * | 10/2014 | Quitmeyer | H01T 21/02 219/121.64 |
| 9,653,885 | B2 * | 5/2017 | Urciuoli | H01T 19/04 |
| 2008/0006255 | A1 * | 1/2008 | Sikora | H01R 13/111 123/634 |
| 2010/0001626 | A1 * | 1/2010 | Maul | H01T 13/36 313/118 |
| 2012/0161604 | A1 * | 6/2012 | Lykowski | H01T 13/04 313/118 |
| 2013/0340697 | A1 * | 12/2013 | Burrows | H01T 13/50 123/146.5 R |

* cited by examiner

HIGH VOLTAGE CONNECTION SEALING METHOD FOR CORONA IGNITION COIL

CROSS REFERENCE TO RELATED APPLICATION

This U.S. Continuation application claims the benefit of U.S. Utility patent application Ser. No. 14/215,375, filed Mar. 17, 2014, which claims the benefit of U.S. Provisional Patent Application No. 61/787,406, filed Mar. 15, 2013, the entire contents of each which are incorporated herein by reference in their entirety.

BACKGROUND OF THE INVENTION

1. Field of the Invention

This invention relates generally to corona ignition assemblies, and methods of manufacturing the corona ignition assemblies.

2. Related Art

Corona discharge ignition systems include a corona igniter assembly typically with a firing end assembly and an ignition coil assembly attached to one another as a single component. The firing end assembly includes a central electrode charged to a high radio frequency voltage potential, creating a strong radio frequency electric field in a combustion chamber. The electric field causes a portion of a mixture of fuel and air in the combustion chamber to ionize and begin dielectric breakdown, facilitating combustion of the fuel-air mixture. The electric field is preferably controlled so that the fuel-air mixture maintains dielectric properties and corona discharge occurs, also referred to as a non-thermal plasma. The ionized portion of the fuel-air mixture forms a flame front which then becomes self-sustaining and combusts the remaining portion of the fuel-air mixture. The electric field is also preferably controlled so that the fuel-air mixture does not lose all dielectric properties, which would create a thermal plasma and an electric arc between the electrode and grounded cylinder walls, piston, or other portion of the igniter. Ideally, the field is also controlled so that the corona discharge only forms at the firing end and not along other portions of the corona igniter assembly. However, such control is oftentimes difficult to achieve.

SUMMARY OF THE INVENTION

One aspect of the invention provides a corona igniter assembly comprising an ignition coil assembly, a firing end assembly, a metal tube, and a rubber boot. The ignition coil assembly receives a radio frequency voltage, and the firing end assembly receives energy from the ignition coil assembly. The firing end assembly includes a corona igniter and distributes a radio frequency electric field, for example in a combustion chamber of an internal combustion engine. The metal tube includes a first tube end attached to the ignition coil assembly and a second tube end attached to the firing end assembly. The metal tube also includes an outer surface and an oppositely facing inner surface surrounding at least a portion of the ignition coil assembly and at least a portion of the firing end assembly. The inner surface of the metal tube presents a tube volume between the first tube end and the second tube end. The tube volume includes space not occupied by the ignition coil assembly and the firing end assembly. The metal tube further includes at least one hole extending through the inner surface and the outer surface for allowing air to exit the tube volume. A rubber boot fills the tube volume and provides a hermetic seal between the ignition coil assembly and the firing end assembly.

Another aspect of the invention provides a method of manufacturing a corona igniter assembly. The method comprises the steps of providing an ignition coil assembly and a firing end assembly; and disposing a rubber boot between the ignition coil assembly and the firing end assembly. The method further includes attaching a first tube end of a metal tube including at least one hole to the ignition coil assembly and attaching a second tube end of the metal tube to the firing end assembly. The metal tube is disposed around the rubber boot, around at least a portion of the ignition coil assembly, and around at least a portion of the firing end assembly. The inner surface of the metal tube presents a tube volume between the first tube end and the second tube end, and the tube volume includes space not occupied by the ignition coil assembly and the firing end assembly. The method next includes compressing the rubber boot between the ignition coil assembly and the firing end assembly so that the rubber boot fills the tube volume and provides a hermetic seal between the ignition coil assembly and the firing end assembly.

When the rubber boot is compressed between the ignition coil assembly and the firing end assembly, the rubber boot pushes any air trapped in the metal tube, between the components of the ignition coil assembly and the firing end assembly, through the holes of the metal tube and out of the corona igniter assembly. The compressed rubber boot also seals any connections between the components and fills any air gaps created by assembly tolerances. Thus, the rubber boot prevents unwanted corona discharge from forming between the firing end assembly and ignition coil assembly, which could occur if a high voltage and frequency electrical field ionizes air trapped between the components. Preventing this unwanted corona discharge allows the energy to be directed to the corona discharge formed at the firing end, which in turn improves the performance of the corona igniter assembly.

BRIEF DESCRIPTION OF THE DRAWINGS

Other advantages of the present invention will be readily appreciated, as the same becomes better understood by reference to the following detailed description when considered in connection with the accompanying drawings wherein.

DESCRIPTION OF THE ENABLING EMBODIMENT

Figure 1:
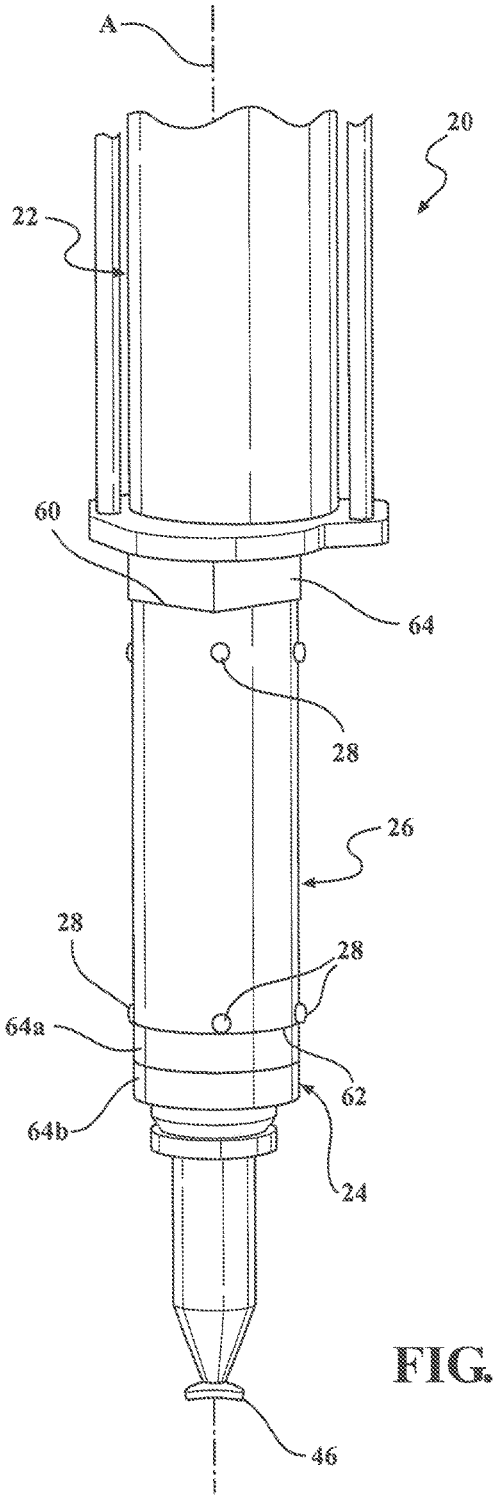
FIG. 1 is a perspective view of a corona igniter assembly comprising an ignition coil assembly and a firing end assembly in an assembled position according to one exemplary embodiment of the invention.
Figure 1A:
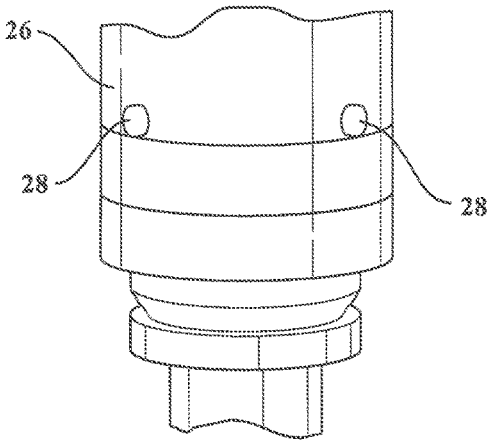
FIG. 1A is an enlarged view of a portion of the corona igniter assembly of FIG. 1 showing a compressed rubber boot extending through holes of a metal tube of the assembly.

A corona igniter assembly 20 for receiving a high radio frequency voltage and distributing a radio frequency electric field in a combustion chamber containing a mixture of fuel and gas to provide a corona discharge is generally shown in FIG. 1. The corona igniter assembly 20 includes an ignition coil assembly 22, a firing end assembly 24, a metal tube 26 surrounding and coupling the ignition coil assembly 22 to the firing end assembly 24, and a rubber boot 28 compressed between the ignition coil assembly 22 and the firing end assembly 24 to fill any air gaps between the components and thus prevent any unwanted corona discharge from forming in those air gaps.

Figure 2:
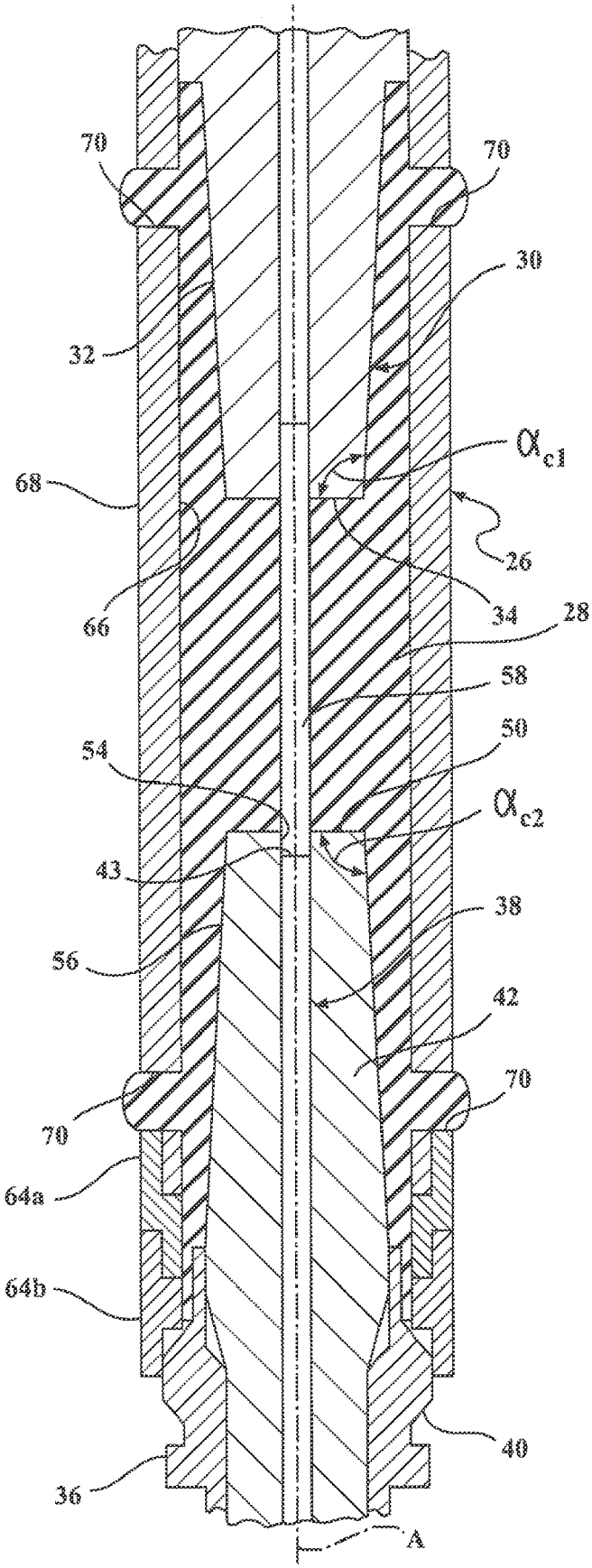
FIG. 2 is an enlarged cross-sectional view of a portion of the corona igniter assembly of FIG. 1 showing an electrical terminal connecting the ignition coil assembly to the firing end assembly.

The ignition coil assembly 22 typically includes a plurality of windings receiving the high radio frequency voltage from a power source and storing the energy. The ignition coil assembly 22 extends along a center axis A and includes a coil output member 30 for transferring the energy to the firing end assembly 24. As shown in FIG. 2, the coil output member 30 presents a first side wall 32 having a conical shape, which tapers toward the center axis A to a first end wall 34. The first side wall 32 also extends longitudinally along the center axis A toward the firing end assembly 24. The first side wall 32 is typically symmetric relative to the center axis A, and the first end wall 34 extends perpendicular to the center axis A. Also shown in FIG. 2, the first side wall 32 is disposed at a first cap angle $\alpha_{c1}$ relative to the first end wall 34. The first end wall 34 presents a first predetermined shape, such as a circular shape, and a first predetermined area.

Figure 3:
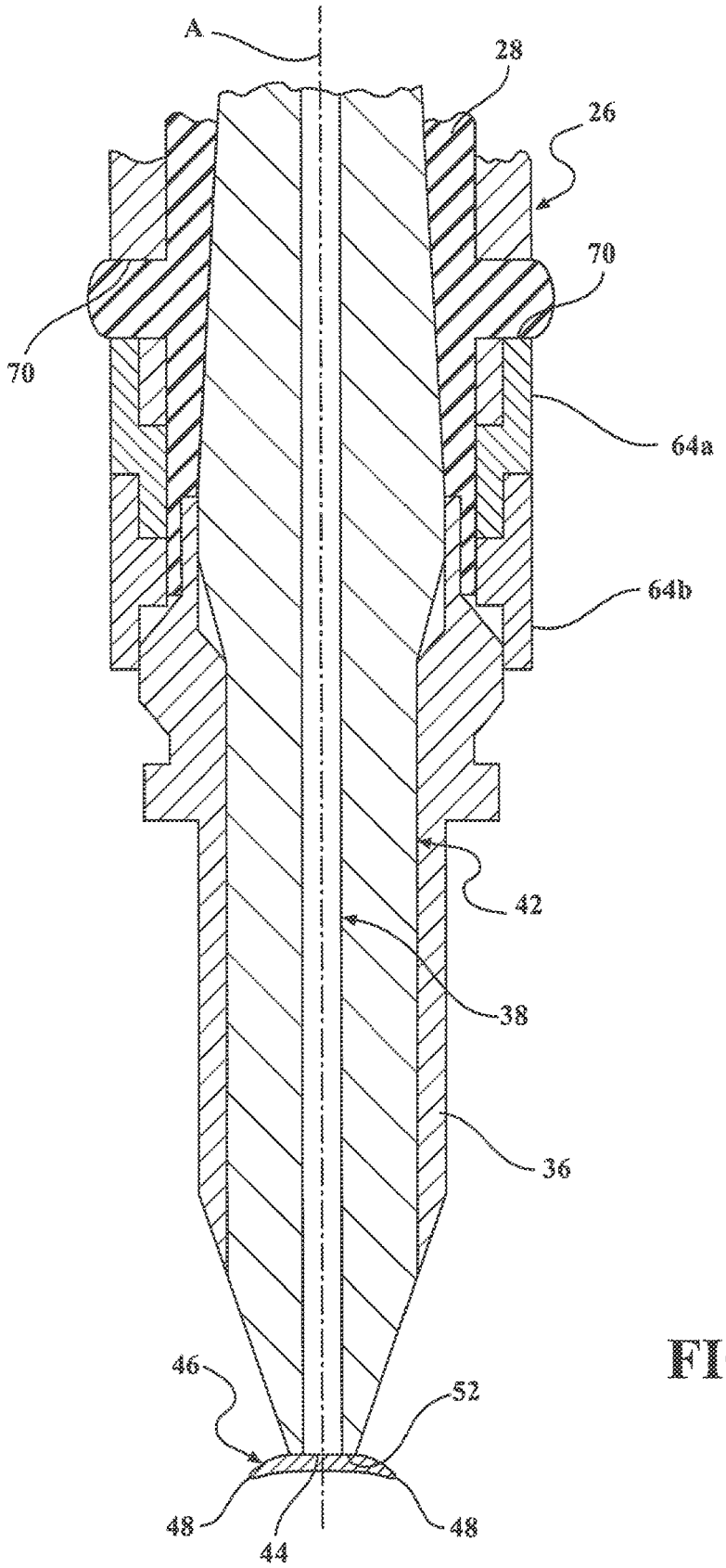
FIG. 3 is an enlarged cross-sectional view of a portion of the corona igniter assembly of FIG. 1.

The firing end assembly 24 includes a corona igniter 36, as best shown in FIGS. 2 and 3, for receiving the energy from the ignition coil assembly 22 and distributing the radio frequency electric field in the combustion chamber. The corona igniter 36 includes an electrode 38, a metal shell 40, and an insulator 42 spacing the electrode 38 from the metal shell 40. The electrode 38 extends longitudinally along the center axis A from a terminal end 43 to a firing end 44. In the exemplary embodiment, the electrode 38 includes a crown 46 at the firing end 44. The crown 46 includes a plurality of branches 48 extending radially outwardly relative to the center axis A for distributing the radio frequency electric field and forming a robust corona discharge.

The insulator 42 is typically formed of a ceramic material and extends along the center axis A from a second end wall 50 to an insulator firing end 52 adjacent the crown 46. In the exemplary embodiment, the crown 46 is disposed outwardly of the insulator firing end 52, and the insulator 42 includes an insulator bore 54 receiving the electrode 38. As shown in FIG. 2, the insulator 42 presents the second end wall 50 and a second side wall 56 having a conical shape, which preferably mirrors the size and shape of the first end wall 34 and the first side wall 32 of the coil output member 30. In this embodiment, the second side wall 56 has a conical shape, which tapers toward the center axis A to the second end wall 50. The second side wall 56 also extends longitudinally along the center axis A toward the ignition coil assembly 22. The second side wall 56 is typically symmetric relative to the center axis A, and the second end wall 50 extends perpendicular to the center axis A. Also shown in FIG. 2, the second side wall 56 is disposed at a second cap angle $\alpha_{c2}$ relative to the second end wall 50. The second end wall 50 presents a second predetermined shape, such as a circular shape, and a second predetermined area. Preferably, the second cap angle $\alpha_{c2}$ is equal to the first cap angle $\alpha_{c1}$, the second predetermined shape is the same as the first predetermined shape of the coil output member 30, and the second predetermined area is equal to the first predetermined area of the coil output member 30. The geometry of the insulator 42 and the geometry of the coil output member 30 can comprise various different geometries, but preferably are designed to allow all air to flow out during assembly, when the rubber boot 28 is put under compression.

The firing end assembly 24 also includes an electrical terminal 58 received in the insulator bore 54 and extending from the electrode 38 to the ignition coil assembly 22 for electrically connecting the electrode 38 of the firing end assembly 24 to the ignition coil assembly 22, as shown in FIG. 2. The metal shell 40 of the firing end assembly 24 surrounds the electrode 38 and the insulator 42.

The corona igniter assembly 20 further includes the metal tube 26 coupling the ignition coil assembly 22 to the firing end assembly 24. The metal tube 26 surrounds at least a portion of the coil output member 30 of the ignition coil assembly 22 and at least a portion of the insulator 42 of the firing end assembly 24. The first end wall 34 and the first side wall 32 of the coil output member 30, as well as the second end wall 50 and the second side wall 56 of the insulator 42, are preferably contained in the metal tube 26. The metal tube 26 is typically formed of aluminum or an aluminum alloy, but may be formed of other materials.

Figure 4:
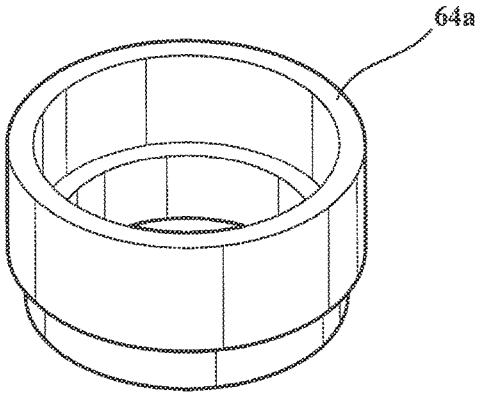
FIG. 4 is a perspective view of a locking nut which can be used to attach the firing end assembly to the metal tube.
Figure 5:
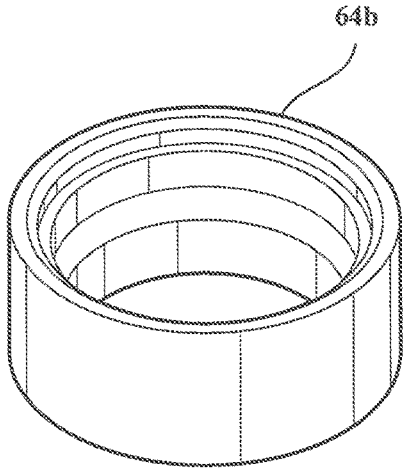
FIG. 5 is a perspective view of a retaining nut which can also be used to attach the firing end assembly to the metal tube.

In the exemplary embodiment shown in FIG. 1, the metal tube 26 extends from a first tube end 60 attached to the ignition coil assembly 22 to a second tube end 62 attached to the firing end assembly 24. The first tube end 60 is attached to the ignition coil assembly 22 along the coil output member 30, and the second tube end 62 is attached to the metal shell 40. A variety of different techniques can be used to attach the metal tube 26 to the ignition coil assembly 22 and the firing end assembly 24. In the exemplary embodiment, a nut 64 is used to connect the first tube end 60 to the ignition coil assembly 22, and two nuts 64 are used to connect the second tube end 62 to the firing end assembly 24. A locking nut 64(*a*), such as the one shown in FIG. 4, is screwed onto the second tube end 62 of the metal tube 26, and a retaining nut 64(*b*), such as the one shown in FIG. 5, is pre-mounted on the shell 40 of the firing end assembly 24 and keeps the shell 40 fixed to the locking nut 64. The metal tube 26 further includes an inner surface 66 and an oppositely facing outer surface 68 each presenting a cylindrical shape between the first tube end 60 and the second tube end 62.

The inner surface 66 of the metal tube 26 presents a tube volume between the first tube end 60 and the second tube end 62. This tube volume includes any space not occupied by the ignition coil assembly 22 and the firing end assembly 24. When the rubber boot 28 is not disposed between the ignition coil assembly 22 and the firing end assembly 24, the tube volume is filled with air or another gas. Even after the rubber boot 28 is disposed between the ignition coil assembly 22 and the firing end assembly 24, but prior to compressing the rubber boot 28 between the ignition coil assembly 22 and the firing end assembly 24, a portion of the tube volume is typically still filled with air. The metal tube 26 further includes at least one hole 70, but preferably a plurality of holes 70 each extending from the inner surface 66 to the outer surface 68 and located between the first tube end 60 and the second tube end 62. These holes 70 allow any air to exit the tube volume when the rubber boot 28 is compressed between the ignition coil assembly 22 and the firing end assembly 24. The location of the holes 70 is calibrated and depends on the size and geometry of the components of the corona igniter assembly 20.

The rubber boot 28 is disposed between the first tube end 60 and the second tube end 62 of the metal tube 26 and then compressed between the ignition coil assembly 22, the firing end assembly 24, and the metal tube 26 to fill the tube volume and provide a hermetic seal between the ignition coil assembly 22, the firing end assembly 24, and the metal tube 26. The rubber boot 28 also provides a hermetic seal between the first tube end 60 and said ignition coil assembly 22, and between the second tube end 62 and the metal shell 40 of the firing end assembly 24.

The compression placed on the rubber boot 28 by the ignition coil assembly 22 and the firing end assembly 24 is preferably symmetrical relative to the center axis A. To provide the hermetic seal, the rubber boot 28 has a boot volume that is greater than the tube volume, and a portion of the rubber boot 28 extends into or through the holes 70 of the metal tube 26. When the rubber boot 28 is compressed, it forces any air remaining in the metal tube 26 through the holes 70 and out of the tube volume. Thus, the rubber boot 28 seals the connections between the ignition coil assembly 22, metal tube 26, and firing end assembly 24. The rubber boot 28 fills any air gaps or clearances, for example those created by assembly tolerances. Therefore, the compressed rubber boot 28 prevents the unwanted corona discharge during operation, which typically forms in air gaps.

In the exemplary embodiment, the rubber boot 28 is formed of silicone rubber, but it can be formed of another type of rubber, or another type of resilient or elastic material. In addition, the design rubber boot 28 is flexible and can comprise a variety of different geometries. Thus, ignition coil assemblies 22 and firing end assemblies 24 of various different designs can be used with the rubber boot 28. When designing the rubber boot 28, the variability factors that should be considered include: the geometrical tolerances of the firing end assembly 24, the ignition coil assembly 22, and the metal tube 26; the process tolerances for the production of the rubber boot 28; and the thermal expansion of the rubber boot 28.

In the exemplary embodiment, the rubber boot 28 extends longitudinally along the center axis A from a first boot end 72 engaging the ignition coil assembly 22 to a second boot end 74 engaging the firing end assembly 24. The rubber boot 28 includes an outside surface 76 presenting a cylindrical shape between the first boot end 72 and the second boot end 74, and a body portion 78 comprising a block of material between the first boot end 72 and the second boot end 74. A channel 80 extends between the first boot end 72 and the second boot end 74 for receiving the electrical terminal 58 extending from the electrode 38 to the ignition coil assembly 22.

Figure 6:
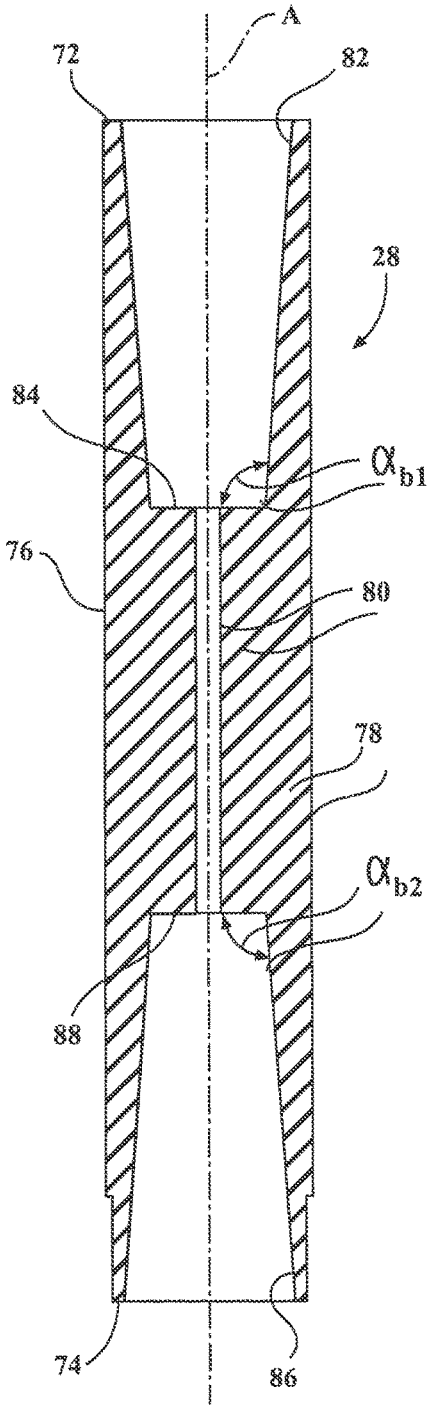
FIG. 6 is a cross-sectional view of the rubber boot according to one exemplary embodiment of the invention.
Figure 7:
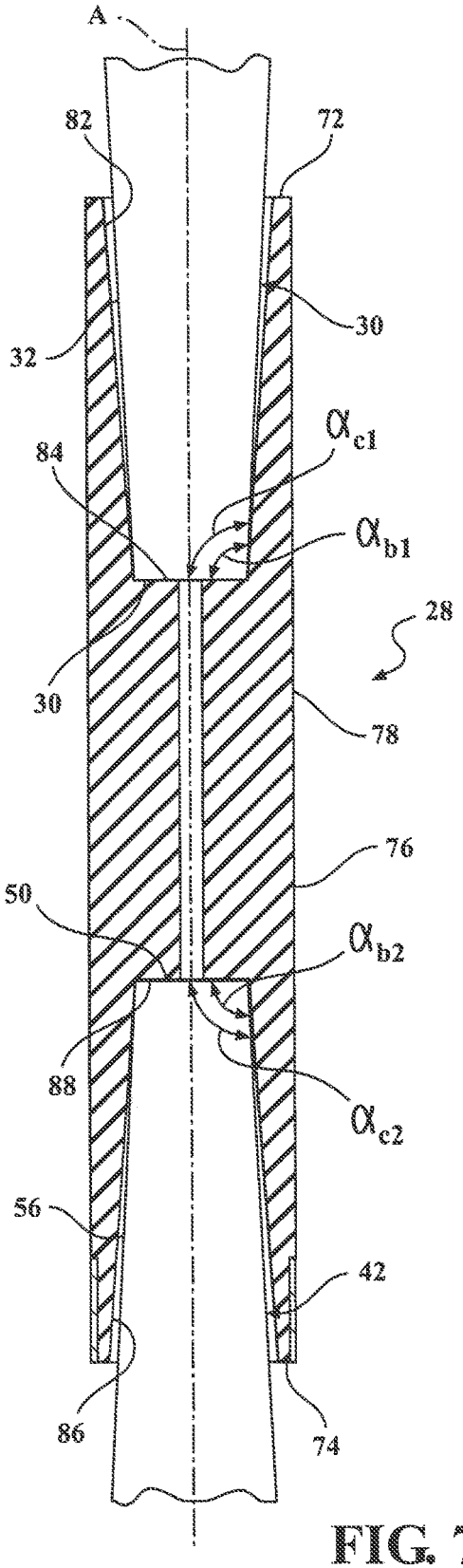
FIG. 7 is a cross-sectional view of the corona igniter assembly according to another exemplary embodiment of the invention prior to compressing the rubber boot between the ignition coil assembly and the firing end assembly.

In the exemplary embodiment, the rubber boot 28 presents a first boot wall 82 having a conical shape and tapering along and toward the center axis A from the first boot end 72 to a first base surface 84, as best shown in FIG. 6. The first boot wall 82 is disposed at a first boot angle $\alpha_{b1}$ relative to the first base surface 84. As best shown in FIG. 7, the first boot wall 82 runs along the first side wall 32 of the coil output member 30, and the first base surface 84 runs along the first end wall 34 of the coil output member 30. The first boot angle $\alpha_{b1}$ is slightly greater than the first cap angle $\alpha_{c1}$ of the coil output member 30 so that any trapped air can be easily pressed out of the tube volume when compressing the rubber boot 28. The first boot wall 82 is also preferably symmetric relative to the center axis A, so that when the rubber boot 28 is compressed, the compression is symmetric and the rubber boot 28 effective seals all areas between the ignition coil assembly 22, metal tube 26, and firing end assembly 24. The first base surface 84 of the rubber boot 28 is disposed adjacent the boot body portion 78 and extends perpendicular to the center axis A. The first base surface 84 presents a first predetermined shape and a first predetermined area. The first predetermined shape and the first predetermined area of the first base surface 84 of the rubber boot 28 is preferably equal to the first predetermined shape and the first predetermined area of the first end wall 34 of the coil output member 30.

The rubber boot 28 also presents a second boot wall 86 having a conical shape and tapering along and toward the center axis A from the second boot end 74 to a second base surface 88. The second boot wall 86 is disposed at a second boot angle $\alpha_{b2}$ relative to the second base surface 88. As best shown in FIG. 6, the second boot wall 86 runs along the second side wall 56 of the insulator 42, and the second base surface 88 runs along the second end wall 50 of the insulator 42. The second boot angle $\alpha_{b2}$ is slightly greater than the second cap angle $\alpha_{c2}$ of the coil output member 30 so that any trapped air can be easily pressed out of the tube volume when compressing the rubber boot 28. The second boot wall 86 is also preferably symmetric relative to the center axis A, so that when the rubber boot 28 is compressed, the compression is symmetric and the rubber boot 28 effective seals all areas between the ignition coil assembly 22, metal tube 26, and firing end assembly 24. The second base surface 88 of the rubber boot 28 is also disposed adjacent the boot body portion 78, opposite the first base surface 84, and extends perpendicular to the center axis A. In the exemplary embodiment, the channel 80 of the rubber boot 28 extends from the first base surface 84 to the second base surface 88. The second base surface 88 presents a second predetermined shape and a second predetermined area. The second predetermined shape and the second predetermined area of the second base surface 88 of the rubber boot 28 is preferably equal to the second predetermined shape and the second predetermined area of the second end wall 50 of the insulator 42. Symmetric compression is also achieved by forming the second boot angle $\alpha_{b2}$ equal to the first boot angle $\alpha_{b1}$, the second predetermined shape of the second base surface 88 equal to the first predetermined shape of the first base surface 84, and the second predetermined area of the second base surface 88 equal to the first predetermined area of the first base surface 84.

Figure 8:
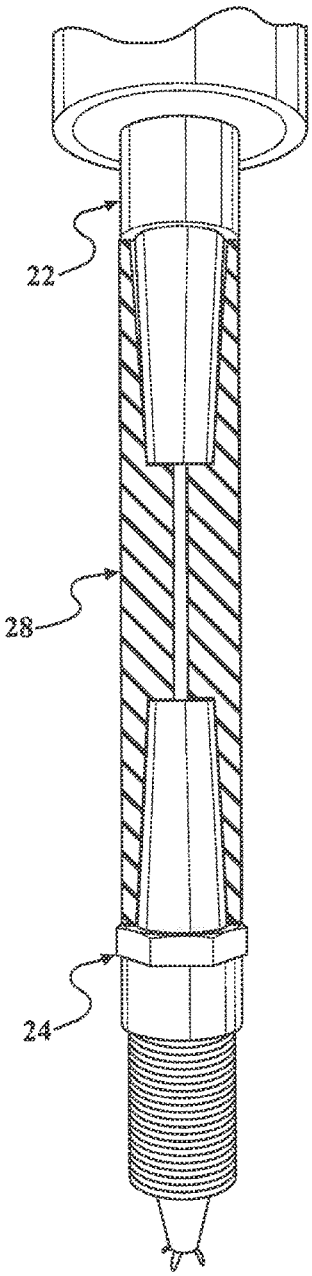
FIG. 8 is a cross-sectional view of the rubber boot disposed between the ignition coil assembly and the firing end assembly prior to compressing the rubber boot.

Another aspect of the invention provides a method of manufacturing the corona igniter assembly 20 including the ignition coil assembly 22, the firing end assembly 24, the metal tube 26, and the rubber boot 28. The method first includes disposing the rubber boot 28 between the ignition coil assembly 22 and the firing end assembly 24. FIG. 8 shows a cross-section of the rubber boot 28 disposed between the ignition coil assembly 22 and the firing end assembly 24, prior to compression.

The method next includes disposing the metal tube 26 around the rubber boot 28, around at least a portion of the ignition coil assembly 22, and around at least a portion of the firing end assembly 24. This step typically first includes inserting the second end wall 50 of the insulator 42 into the metal tube 26 through the second tube end 62. Next, the method includes inserting the rubber boot 28 into the metal tube 26 through first tube end 60 and disposing the second base surface 88 of the rubber boot 28 on the second end wall 50 of the insulator 42. The method further includes inserting the coil output member 30 of the ignition coil assembly 22 through the first tube end 60, into the metal tube 26, and disposing the first end wall 34 of the coil output member 30 on the first base surface 84 of the rubber boot 28. At this point, the rubber boot 28 is not compressed, and any space not occupied by the ignition coil assembly 22, the firing end assembly 24, or the rubber boot 28 is filled with air.

The method further includes attaching the first tube end 60 of the metal tube 26 to the ignition coil assembly 22 and attaching the second tube end 62 of the metal tube 26 to the firing end assembly 24. As discussed above, the retaining nut 64(*b*) can be pre-mounted on the metal shell 40 of the firing end assembly 24, and the locking nut 64(*a*) can be screwed onto the metal tube 26, and the two nuts 64(*a*), 64(*b*), can be joined together to connect the metal tube 26 to the metal shell 40 of the firing end assembly 24. A nut 64 can also be used to connect the second tube end 62 to the ignition coil assembly 22.

Figure 9:
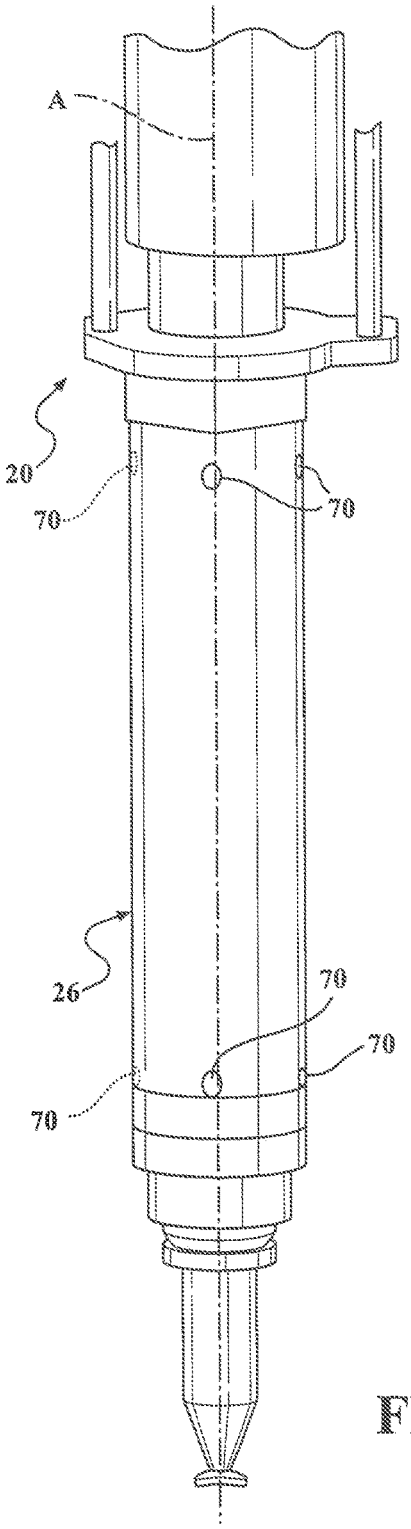
FIG. 9 is a perspective view of the corona igniter assembly of FIG. 1 prior to compressing the rubber boot between the ignition coil assembly and the firing end assembly.
Figure 9A:
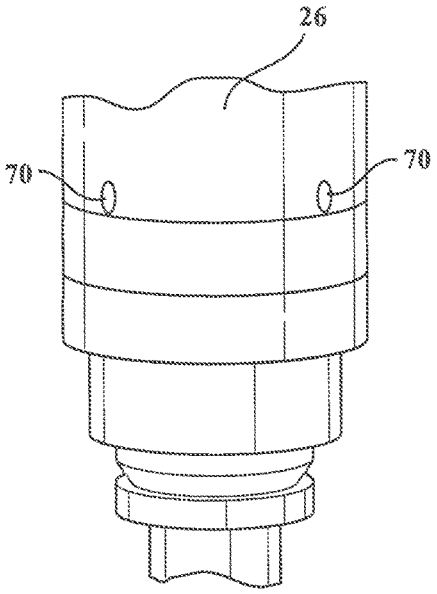
FIG. 9A is an enlarged cross-sectional view of a portion of the corona igniter assembly of FIG. 9 wherein the rubber boot does not extend through the holes of the metal tube.
Figure 10:
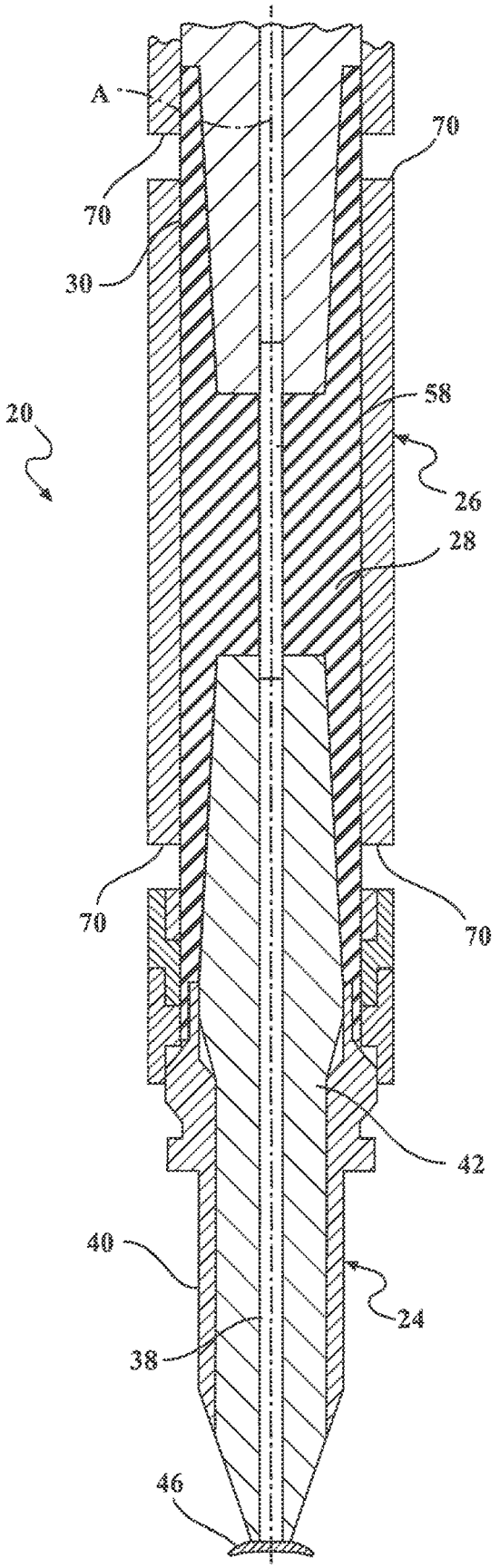
FIG. 10 is an enlarged cross-sectional view of a portion of the corona igniter assembly of FIG. 9 prior to compressing the rubber boot.

The method next includes compressing the rubber boot 28 between the coil output member 30 of the ignition coil assembly 22 and the insulator 42 of the firing end assembly 24 so that the rubber boot 28 fills the tube volume and provides the hermetic seal between the ignition coil assembly 22 and the firing end assembly 24. FIGS. 9, 9A, and 10 show the corona igniter assembly 20 prior to compressing the rubber boot 28, wherein no portion of the rubber boot 28 extends through the holes 70 of the metal tube 26. A compression frame with bolts is typically attached to the ignition coil assembly 22 to apply a uniform pressure in order to compress the rubber boot 28. The step of compressing the rubber boot 28 between the ignition coil assembly 22 and the firing end assembly 24 includes removing air from the tube volume by pressing the air through the holes 70 of the metal tube 26, and then pressing a portion of the rubber boot 28 into or through the holes 70 of the metal tube 26. Preferably, the rubber boot 28 is compressed symmetrically relative to the center axis A to prove a secure seal between the components.

Obviously, many modifications and variations of the present invention are possible in light of the above teachings and may be practiced otherwise than as specifically described while within the scope of the appended claims.

What is claimed is:

1. An igniter assembly comprising:

a metal tube;

an ignition coil device coupled to one end of said metal tube;

an igniter device coupled to an opposite end of said lube;

an interior space of said metal tube that is not occupied by either said ignition coil or said igniter;

at least one opening extending through a wall of said metal tube in communication with said interior space;

an elastomeric plug disposed in said interior space sealing said at least one opening and providing a hermetic seal between said ignition coil device and said igniter device; and wherein said elastomeric plug includes a first cup-shaped recess at said one end surrounding a portion of said ignition coil device received therein.

2. The assembly of claim 1 wherein said elastomeric plug includes a second cup-shaped recess at said opposite end surrounding a portion of said igniter device received therein.

3. The assembly of claim 2 wherein said elastomeric plug includes a channel connecting said first and second cup-shaped recesses.

4. The assembly of claim 3 including an electrical terminal disposed in said channel.

5. The assembly of claim 1 wherein said elastomeric plug includes a channel extending between said ignition coil device and said igniter device and in which an electrical terminal is disposed.

6. The assembly of claim 2 wherein said igniter device includes a ceramic insulator having said portion thereof received in said second cup-shaped recess.

7. The assembly of claim 6 wherein said ceramic insulator has a bore and including an electrode disposed in said bore.

8. The assembly of claim 7 including a firing tip crown disposed on a free end of said electrode and operative to produce a corona ignition when the igniter assembly is fired.

9. The assembly of claim 8 wherein the firing tip crown projects beyond said opposite end of said metal tube and the igniter assembly is devoid of a ground electrode and devoid of a spark gap.

10. The assembly of claim 1 wherein the elastomeric plug extends at least partially into said at least one opening.

11. The assembly of claim 1 wherein there is a plurality of said openings communicating with said interior space and all are sealed by said elastomeric plug.

12. The assembly of claim 1 wherein said igniter device is a corona ignition device.

13. The assembly of claim 1 wherein said ignition coil device is spaced longitudinally from said igniter device and electrically coupled by an electrode extending through a channel of said elastomeric plug.

14. An igniter assembly comprising:

a metal tube;

an ignition coil device coupled to one end of said metal tube;

an igniter device coupled to an opposite end of said tube;

an interior space of said metal tube that is not occupied by either said ignition coil or said igniter;

at least one opening extending through a wall of said metal tube in communication with said interior space;

an elastomeric plug disposed in said interior space sealing said at least one opening and providing a hermetic seal between said ignition coil device and said igniter device; and wherein said elastomeric plug includes a recess at said one end and a recess at said opposite end;

said recesses being spaced longitudinally from one another by a central body portion of said elastomeric plug and interconnected by a central channel extending through said central body portion.

* * * * *